US010959015B2

(12) United States Patent
Briggs et al.

(10) Patent No.: US 10,959,015 B2
(45) Date of Patent: Mar. 23, 2021

(54) WIRELESS EARPIECE HAVING ANTENNA WITH WALL-EMBEDDED RADIATING ELEMENT AND RELATED TECHNOLOGY

(71) Applicant: New Audio LLC, New York, NY (US)

(72) Inventors: Drew Stone Briggs, Seattle, WA (US); Thomas C. Wilson, Brooklyn, NY (US); Nicholas Slaney, Jersey City, NJ (US); Jonathan E. Levine, New York, NY (US)

(73) Assignee: New Audio LLC, New York, NY (US)

( * ) Notice: Subject to any disclaimer, the term of this patent is extended or adjusted under 35 U.S.C. 154(b) by 0 days.

(21) Appl. No.: 16/893,202

(22) Filed: Jun. 4, 2020

(65) Prior Publication Data

US 2020/0304902 A1 Sep. 24, 2020

Related U.S. Application Data

(63) Continuation of application No. 16/031,983, filed on Jul. 10, 2018.

(51) Int. Cl.
*H04R 1/10* (2006.01)
*H04R 5/033* (2006.01)

(52) U.S. Cl.
CPC ..... *H04R 1/1066* (2013.01); *H04R 1/1016* (2013.01); *H04R 1/1075* (2013.01); *H04R 5/033* (2013.01)

(58) Field of Classification Search
CPC ..... H04R 5/033; H04R 25/00; H04R 25/554; H04R 25/65; H04R 2201/10; H04R 2225/031; H04R 2225/025; H04R 2225/51
USPC ..... 381/380, 312–331
See application file for complete search history.

(56) References Cited

U.S. PATENT DOCUMENTS

| | | | | |
|---|---|---|---|---|
| 4,739,512 | A * | 4/1988 | Hartl | H04R 25/65 381/328 |
| 7,986,803 | B1 | 7/2011 | Dekalb | |
| D780,155 | S | 2/2017 | Levine et al. | |
| 9,706,318 | B2 * | 7/2017 | So | H04R 25/65 |
| D820,810 | S | 6/2018 | Levine et al. | |

(Continued)

FOREIGN PATENT DOCUMENTS

| | | |
|---|---|---|
| CN | 106709555 A | 5/2017 |
| KR | 2017004192 | 12/2017 |
| WO | 2015042335 A1 | 3/2015 |

*Primary Examiner* — Ahmad F. Matar
*Assistant Examiner* — Sabrina Diaz
(74) *Attorney, Agent, or Firm* — Holzer Patel Drennan

(57) ABSTRACT

An earpiece in accordance with at least some embodiments of the present technology includes a housing and a speaker within the housing. The earpiece also includes an antenna at least partially embedded within a wall of the housing. The wall includes a window portion and an opaque portion extending around the window portion. The antenna is visible from outside the housing via the window portion. The window portion includes a transparent filler within an elongate groove in the wall. The antenna includes a radiating element within the groove, and feeding and shorting pins extending through respective openings between the groove to an interior of the housing. Making the earpiece can include disposing filler material over the radiating element, increasing a hardness of the filler material, and abrading an outer surface of the wall at the filler material to form a smooth surface.

14 Claims, 4 Drawing Sheets

(56) References Cited

U.S. PATENT DOCUMENTS

| | | | | |
|---|---|---|---|---|
| D860,975 | S | 9/2019 | Briggs et al. | |
| D872,060 | S | 1/2020 | Briggs et al. | |
| 2003/0174853 | A1 | 9/2003 | Howes et al. | |
| 2008/0031481 | A1 | 2/2008 | Warren et al. | |
| 2010/0315299 | A1* | 12/2010 | Bibl | H04R 1/1041 343/702 |
| 2010/0321253 | A1* | 12/2010 | Ayala Vazquez | H01Q 1/2258 343/702 |
| 2013/0076573 | A1* | 3/2013 | Rappoport | H01Q 1/243 343/702 |
| 2014/0286515 | A1 | 9/2014 | Bone et al. | |
| 2015/0358711 | A1 | 12/2015 | Tan et al. | |
| 2016/0249133 | A1 | 8/2016 | Sørensen | |
| 2016/0286300 | A1 | 9/2016 | Hussein et al. | |
| 2016/0337766 | A1* | 11/2016 | Flaig | H04R 25/60 |
| 2017/0054196 | A1* | 2/2017 | Hu | H01Q 5/357 |
| 2017/0094386 | A1 | 3/2017 | Trainer et al. | |
| 2017/0294720 | A1 | 10/2017 | Murakowski et al. | |
| 2017/0339479 | A1 | 11/2017 | Levine | |
| 2018/0020277 | A1 | 1/2018 | Briggs | |
| 2018/0332379 | A1 | 11/2018 | McGarry et al. | |
| 2019/0117155 | A1* | 4/2019 | Cross | H04R 25/30 |
| 2019/0200112 | A1 | 6/2019 | Briggs et al. | |

* cited by examiner

WIRELESS EARPIECE HAVING ANTENNA WITH WALL-EMBEDDED RADIATING ELEMENT AND RELATED TECHNOLOGY

INCORPORATION BY REFERENCE

U.S. patent application Ser. No. 15/650,799, filed on Jul. 14, 2017, and titled "Wearable Audio Device Having External Antenna and Related Technology" is incorporated herein by reference in its entirety. To the extent the foregoing patent application or any other material incorporated herein by reference conflicts with the present disclosure, the present disclosure controls.

TECHNICAL FIELD

The present technology is related to wearable audio devices, such as audio devices including wireless ear-supported or head-supported earpieces.

BACKGROUND

Wearable audio devices typically include an earpiece configured to be worn at a user's ear. The earpiece can include a speaker that converts an audio signal into sound. Because the sound is generated near a user's ear drum, the sound may be fully audible to the user while still being inaudible or minimally audible to others around the user. For this reason, wearable audio devices tend to be well-suited for use in public settings. Some wearable audio devices include one or two ear-supported earpieces. Examples of ear-supported earpieces include earpieces including earbuds shaped to extend into a user's ear canal and earpieces including hooks shaped to extend over a user's auricle. Other wearable audio devices include one or two head-supported earpieces. Examples of head-supported earpieces include earpieces at opposite respective ends of a headpiece shaped to bridge a user's head. Ear-supported and head-supported earpieces can be wired or wireless. Wired earpieces receive audio content from an audio player via a wire. Wireless earpieces receive audio content from an audio player via Bluetooth or a similar wireless communication standard. In a wearable audio device including a wireless earpiece, the earpiece may still be connected to another earpiece or to a control element via a wire.

BRIEF DESCRIPTION OF THE DRAWINGS

Many aspects of the present technology can be better understood with reference to the following drawings. The components in the drawings are not necessarily to scale. Instead, emphasis is placed on illustrating clearly the principles of the present technology. For ease of reference, throughout this disclosure identical reference numbers may be used to identify identical, similar, or analogous components or features of more than one embodiment of the present technology.

DETAILED DESCRIPTION

Specific details of wearable audio devices and related devices, systems, and methods in accordance with several embodiments of the present technology are described herein with reference to FIGS. 1-6. Although wearable audio devices and related devices, systems, and methods may be disclosed herein primarily or entirely in the context of ear-supported earpieces, other types of earpieces are also within the scope of the present technology. For example, suitable features of described ear-supported earpieces can be implemented in the context of head-supported earpieces. Furthermore, it should be understood in general that other devices, systems, and methods in addition to those disclosed herein are within the scope of the present technology. For example, devices, systems, and methods in accordance with embodiments of the present technology can have different and/or additional configurations, components, and operations than those disclosed herein. Moreover, a person of ordinary skill in the art will understand that devices, systems, and methods in accordance with embodiments of the present technology can be without one or more of the configurations, components, and operations disclosed herein without deviating from the present technology.

Figure 1:
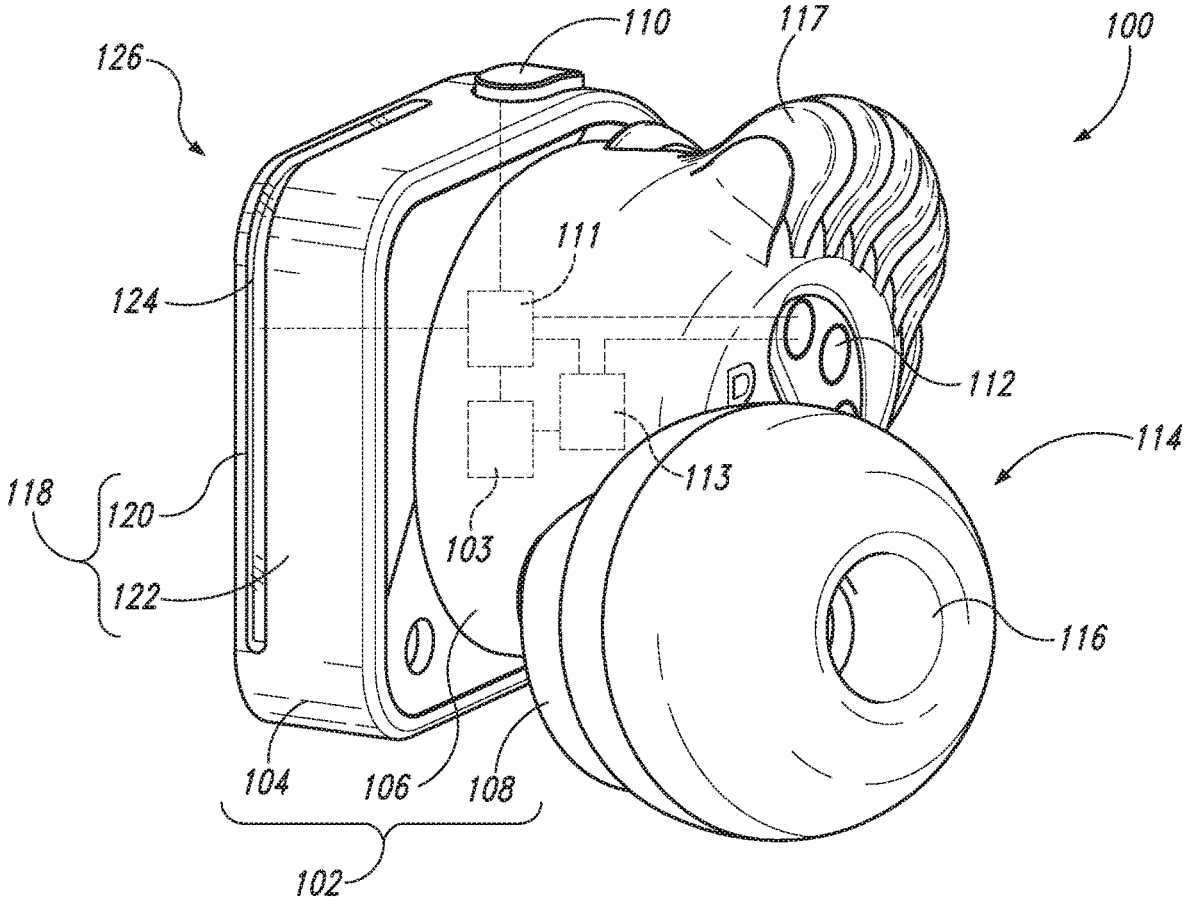
FIG. 1 is a perspective view of an earpiece in accordance with at least some embodiments of the present technology taken from above, in front of, and to the right of the earpiece.

FIG. 1 is a perspective view of an earpiece 100 in accordance with at least some embodiments of the present technology taken from above, in front of, and to the right of the earpiece 100. As shown in FIG. 1, the earpiece 100 can include a housing 102 and a speaker 103 (shown schematically) within the housing 102. The housing 102 can have a first portion 104, a second portion 106, and a third portion 108 connected to one another in series. At the first portion 104 of the housing 102, the earpiece 100 can include a button 110 operably connected to processing circuitry 111 (shown schematically) within the housing 102. At the second portion 106 of the housing 102, the earpiece 100 can include charging pins 112 (one labeled) also operably connected to the processing circuitry 111. The earpiece 100 can also include a battery 113 (shown schematically) within the housing 102. The battery 113 can be operably connected to the speaker 103, the processing circuitry 111, and the charging pins 112.

The earpiece 100 can further include an earbud 114 carried by the housing 102. The earbud 114 can be positioned to extend outwardly from the housing 102 toward a canal of a user's ear when the earpiece 100 is mounted to the user's ear. For example, the earbud 114 can include a rigid stem (not shown) extending outwardly from the third portion 108 of the housing 102. The earbud 114 can also include a removable cushion 116 extending circumferentially around the stem. The cushion 116 can be shaped to be snugly received within a canal of a user's ear when the earpiece 100 is mounted to the user's ear. The earpiece 100 can further include a stabilizer accessory 117 carried by the housing 102. The stabilizer accessory 117 can be configured to facilitate secure attachment of the earpiece 100 to a user's ear when the earpiece 100 is mounted to the user's ear. In at least some cases, the stabilizer accessory 117 is removably connected to the second portion 106 of the housing 102.

As shown in FIG. 1, the housing 102 can include a wall 118 having a window portion 120 and an opaque portion 122 extending around the window portion 120. The earpiece 100 can include an antenna 124 at least partially embedded within the wall 118. In at least some cases, the processing circuitry 111 is configured to receive audio content via the antenna 124 and is configured to generate sound corresponding to the audio content via the speaker 103. The earpiece 100 can have a corner 126 positioned to be at an anteriormost and superiormost portion of the earpiece 100 when a user wears the earpiece 100. The antenna 124 and the window portion 120 of the wall 118 and can extend around the corner 126 and along a significant portion (e.g., greater than 25% by length) of upper and forward sides of the first portion 104 of the housing 102.

Embedding at least a portion of the antenna 124 within the wall 118 can enhance the fidelity of short-range radiofrequency communication via the antenna 124. For example, embedding at least a portion of the antenna 124 within the wall 118 can move the antenna 124 farther from internal and external sources of interference and variability than would otherwise be possible if the antenna 124 was entirely within the housing 102. Internal sources of interference and variability include, for example, internal wires that may shift over time (e.g., due to routine handling of the earpiece 100) and thereby cause the radiofrequency-receiving characteristics of the antenna 124 to be different than they were when the earpiece 100 was originally manufactured and tuned. External sources of interference and variability include, for example, a user's head when the earpiece 100 is worn at the user's ear. Embedding at least a portion of the antenna 124 within the wall 118 can also be useful to stabilize the position of the antenna 124 relative to the other components of the earpiece 100. This too can enhance the fidelity of short-range radiofrequency communication via the antenna 124.

Figure 2:
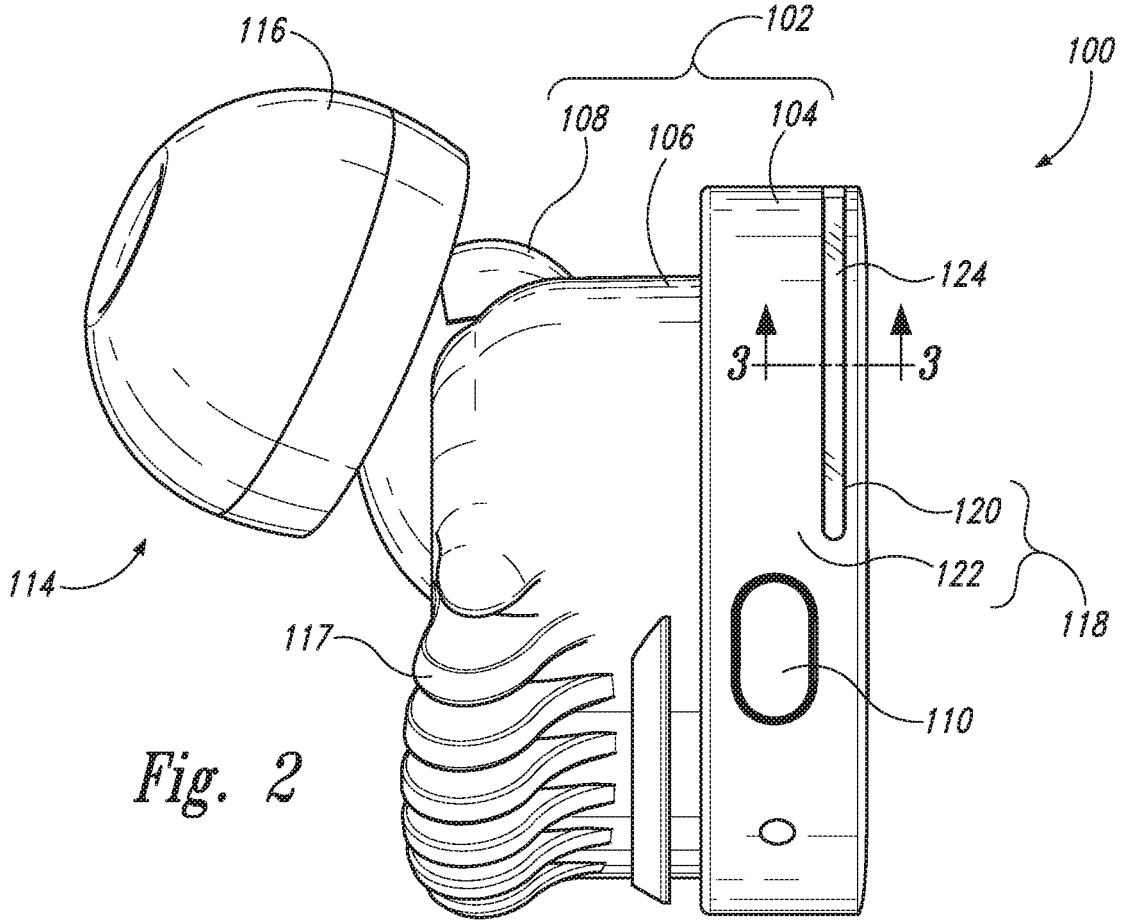
FIG. 2 is a top plan view of the earpiece shown in FIG. 1.
Figure 3:
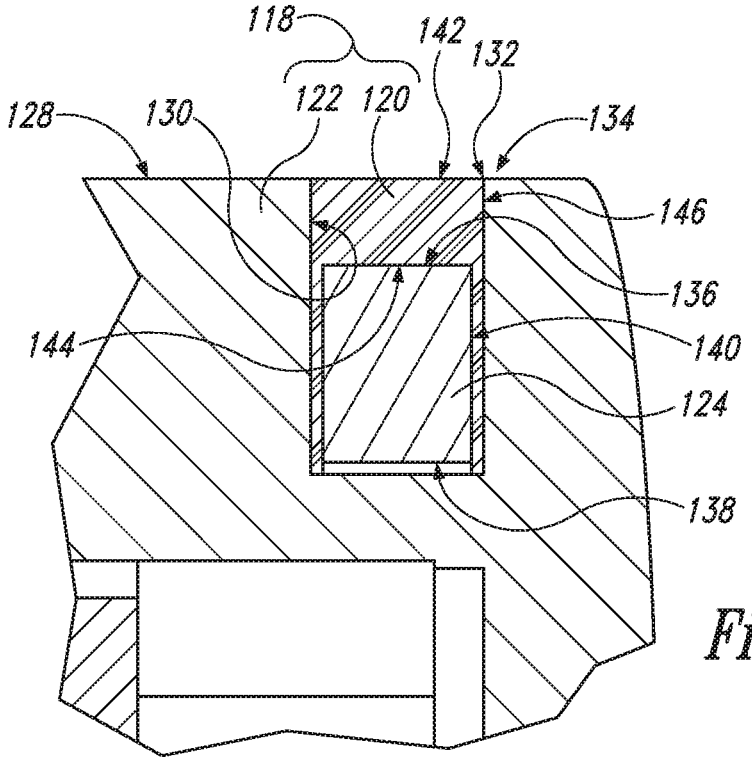
FIG. 3 is an enlarged cross-sectional view of a portion of the earpiece shown in FIG. 1 taken along the line 3-3 in FIG. 2.

FIG. 2 is a top plan view of the earpiece 100. FIG. 3 is an enlarged cross-sectional view of a portion of the earpiece 100 taken along the line 3-3 in FIG. 2. As shown in FIG. 3, the wall 118 can have an outer surface 128, and an elongate groove 130 recessed inwardly relative to the outer surface 128. The groove 130 can have a rim 132 at the outer surface 128. The opaque portion 122 of the wall 118 can extend around the rim 132. The antenna 124 and the window portion 120 of the wall 118 can be within the groove 130. For example, the antenna 124 can be at a base of the groove 130, and the window portion 120 of the wall 118 can overlie the antenna 124. With reference now to FIG. 1-3 together, like the antenna 124 and the window portion 120 of the wall 118, the groove 130 can extend around the corner 126 and along a significant portion (e.g., greater than 25% by length) of upper and forward sides of the first portion 104 of the housing 102.

The antenna 124 can be visible from outside the housing 102 via the window portion 120 of the wall 118. The opaque portion 122 of the wall 118, in contrast, can obscure the speaker 103, the processing circuitry 111, and other internal components of the earpiece 100. The transparency of the window portion 120 of the wall 118 can be useful, for example, to protect and secure the antenna 124 without preventing the location of the antenna 124 from being readily identifiable to a user of the earpiece 100. In some cases, the window portion 120 of the wall 118 is a transparent filler formed by an in-situ transition from a liquid to a solid. For example, the window portion 120 of the wall 118 can be made at least primarily of transparent epoxy or another suitable type of adhesive material that is transparent when solid. In other cases, the window portion 120 of the wall 118 can be a solid insert shaped to fit snuggly within the groove 130. In these cases, the window portion 120 of the wall 118 can be secured within the groove 130 by friction and/or by a separate adhesive material. In still other cases, the window portion 120 of the wall 118 can have other suitable forms. Furthermore, in some embodiments, a counterpart of the window portion 120 is opaque rather than transparent. For example, the counterpart of the window portion 120 can be made at least primarily of adhesive material that is opaque when solid and/or an opaque insert. In these embodiments, the advantages discussed above with regard to the positioning and embedding of the antenna 124 may be applicable whereas the advantages discussed above with regard to the transparency of the window portion 120 of the wall 118 may not be applicable.

With reference again to FIG. 3, the wall 118 can have a transition region 134 at which the opaque portion 122 of the wall 118 is directly adjacent to the window portion 120 of the wall 118. The outer surface 128 of the wall 118 can extend over the opaque portion 122 of the wall 118, the transition region 134, and the window portion 120 of the wall 118. In at least some cases, the outer surface 128 of the wall 118 is flush at the transition region 134. For example, the outer surface 128 of the wall 118 can include no sharp elevation difference at the transition region 134. This can be useful, for example, to facilitate cleaning the earpiece 100. The opaque portion 122 of the wall 118 can be made at least primarily of a material well suited for durability, biocompatibility, and machinability. Furthermore, the opaque portion 122 of the wall 118 and the window portion 120 of the wall 118 can be electrically insulative and, therefore, transparent to radio waves. In at least some cases, the opaque portion 122 of the wall 118 is made at least primarily of cellulose acetate.

As shown in FIG. 3, the antenna 124 can have a first major surface 136, a second major surface 138, and a first edge surface 140 extending between respective perimeters of the first and second major surfaces 136, 138. The second major surface 138 of the antenna 124 can be opposite to the first major surface 136 of the antenna 124 and closer than the first major surface 136 of the antenna 124 to the speaker 103, the processing circuitry 111, and other internal components of the earpiece 100. Similarly, the window portion 120 of the wall 118 can have a third major surface 142, a fourth major surface 144, and a second edge surface 146 extending between respective perimeters of the third and fourth major surfaces 142, 144. The fourth major surface 144 the of the window portion 120 of the wall 118 can be opposite to the third major surface 142 of the window portion 120 of the wall 118 and closer than the third major surface 142 of the window portion 120 of the wall 118 to the speaker 103, the processing circuitry 111, and other internal components of the earpiece 100.

As also shown in FIG. 3, the fourth major surface 144 of the window portion 120 of the wall 118 and the first major surface 136 of the antenna 124 can be directly adjacent to one another such that the window portion 120 of the wall 118 extends between the antenna 124 and the outer surface 128 of the wall 118. The opaque portion 122 of the wall 118 can be directly adjacent to the window portion 120 of the wall 118 along the second edge surface 146 of the window portion 120 of the wall 118. In some cases, the opaque portion 122 of the wall 118 is spaced apart from the antenna 124 along the first edge surface 140 of the antenna 124. In other cases, the opaque portion 122 of the wall 118 can be directly adjacent to the antenna 124 along the first edge surface 140 of the antenna 124. In at least some cases, a total length of the second edge surface 146 of the window portion 120 of the wall 118 is at most 20% different than a total length of the first edge surface 140 of the antenna 124. In addition or alternatively, the window portion 120 of the wall 118 and the antenna 124 can be approximately coextensive.

Figure 4:
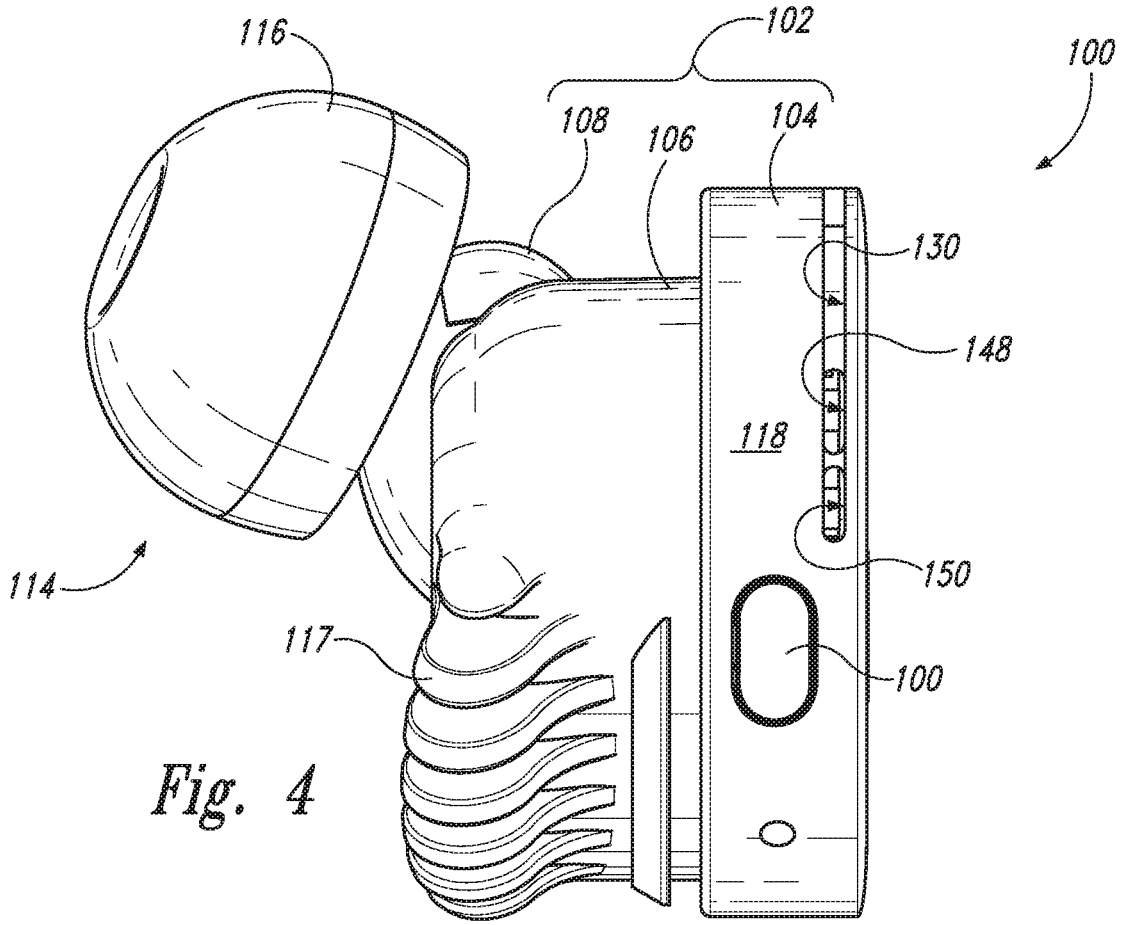
FIG. 4 is a top plan view of the earpiece shown in FIG. 1 with selected portions of the earpiece omitted to show underlying features.
Figure 5:
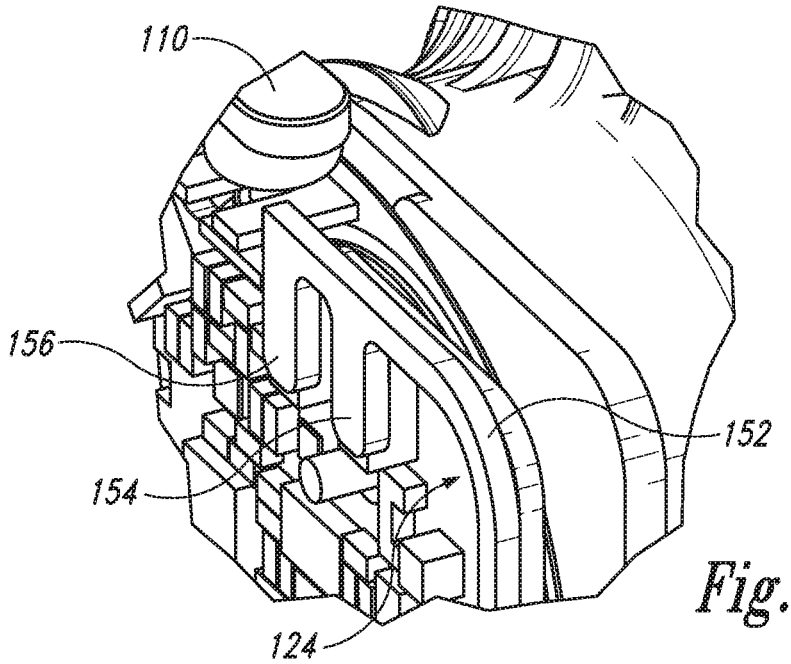
FIG. 5 is an enlarged cutaway perspective view of a portion of the earpiece shown in FIG. 1 taken from above, in front of, and to the left of the earpiece and with selected portions of the earpiece omitted to show underlying features.

FIG. 4 is a top plan view of the earpiece 100 with the window portion 120 of the wall 118 and the antenna 124 omitted to show underlying features. As shown in FIG. 4, the wall 118 can include a first opening 148 and a second opening 150 individually extending from the groove 130 to an interior of the housing 102. FIG. 5 is an enlarged cutaway perspective view of a portion of the earpiece 100 taken from above, in front of, and to the left of the earpiece 100 and with the wall 118 omitted to show underlying features. With reference to FIGS. 4 and 5 together, the antenna 124 can be an inverted-F antenna and can include a radiating element 152 within the groove 130, a feeding pin 154 extending through the first opening 148, and a shorting pin 156 extending through the second opening 150. In other embodiments, the antenna 124 can have another suitable form.

Figure 6:
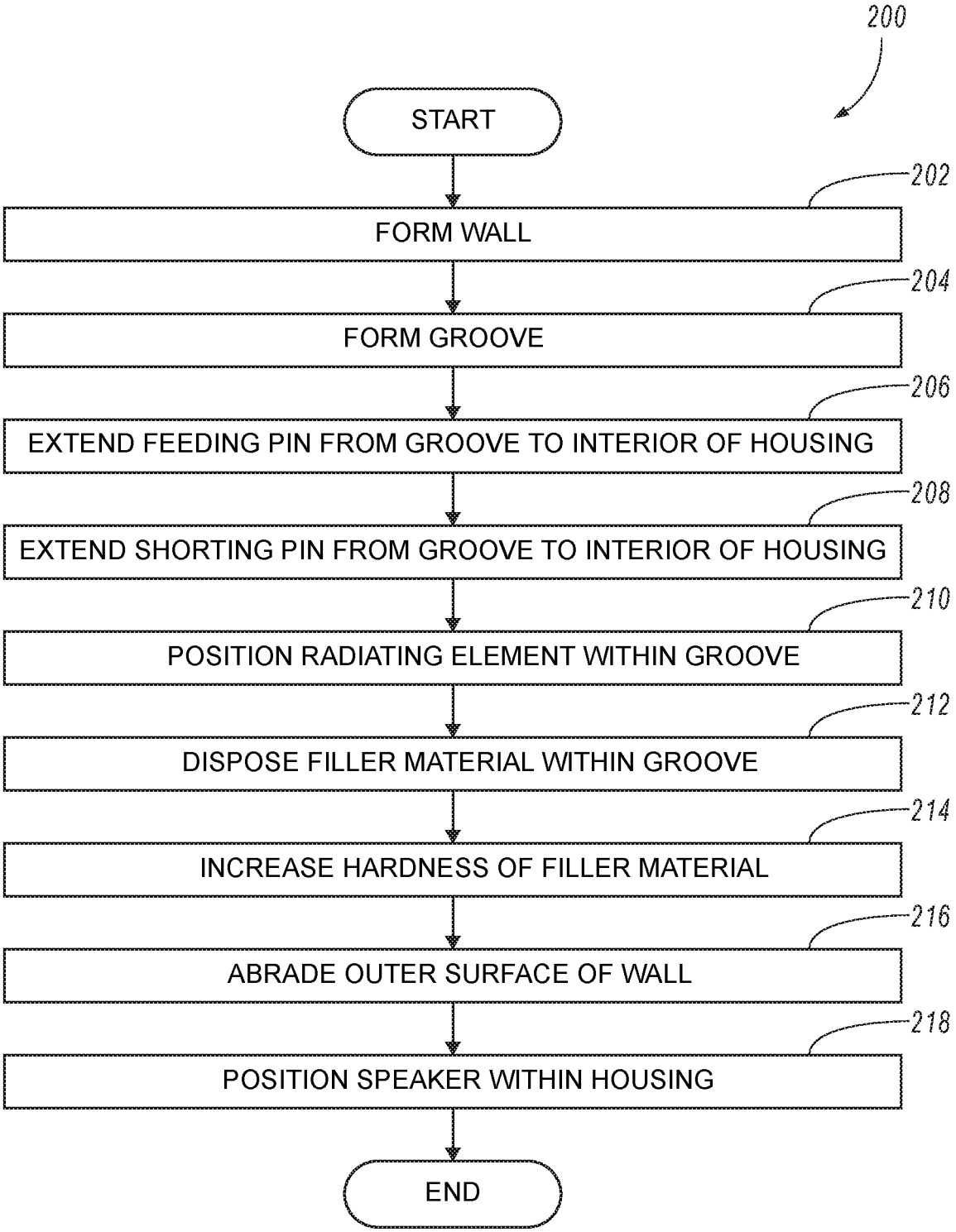
FIG. 6 is a flow chart illustrating a method for making an earpiece in accordance with at least some embodiments of the present technology.

FIG. 6 is a flow chart illustrating a method 200 for making an earpiece in accordance with at least some embodiments of the present technology. The method 200 will be described with reference to the earpiece 100. It should be understood, however, that the method 200 can also be used with earpieces other than the earpiece 100. With reference to FIGS. 1-6 together, the method 200 can include forming the wall 118 by molding, extruding, or using another suitable forming process on a polymer (e.g., cellulose acetate) or another suitable material (block 202). The method 200 can also include forming the groove 130 (block 204). In some cases, this includes using a subtractive machining tool, such as miniature grinding head under computer numerical control. In other cases, the groove 130 can be formed with other portions of the wall 118, such as by incorporating the groove 130 into a mold for the wall 118. Next, the method 200 can include embedding the antenna 124 in the wall 118. This can include extending the feeding pin 154 from the groove 130 to the interior of the housing 102 via the first opening 148 (block 206), extending the shorting pin 156 from the groove 130 to the interior of the housing 102 via the second opening 150 (block 208), and positioning the radiating element 152 within the groove 130 (block 210).

After the antenna 124 is positioned in the groove 130, the method 200 can include forming the window portion 120 of the wall 118. In some cases, this includes disposing filler material (e.g., epoxy resin) within the groove 130 such that the filler material at least partially covers the radiating element 152 (block 212), and increasing a hardness of the filler material (block 214). In other cases, the window portion 120 of the wall 118 can be formed by positioning a suitable insert within the groove 130. Adhesive can also be added to the groove 130 to secure the insert. Whether the window portion 120 of the wall 118 is a hardened filler material, an insert, or has another suitable form, the method 200 can further include abrading the outer surface 128 of the wall 118 (block 216) after the window portion 120 of the wall 118 is formed. For example, a portion of the outer surface 128 of the wall 118 extending over the transition region 134 between the window portion 120 of the wall 118 and the opaque portion 122 of the wall 118 can be abraded (e.g., by polishing, grinding, scraping, etc.) to form a smooth surface. Finally, the method 200 can include positioning the speaker 103 within the housing 102 (block 218).

This disclosure is not intended to be exhaustive or to limit the present technology to the precise forms disclosed herein. Although specific embodiments are disclosed herein for illustrative purposes, various equivalent modifications are possible without deviating from the present technology, as those of ordinary skill in the relevant art will recognize. In some cases, well-known structures and functions have not been shown and/or described in detail to avoid unnecessarily obscuring the description of the embodiments of the present technology. Although steps of methods may be presented herein in a particular order, in alternative embodiments the steps may have another suitable order. Similarly, certain aspects of the present technology disclosed in the context of particular embodiments can be combined or eliminated in other embodiments. Furthermore, while advantages associated with certain embodiments may have been disclosed in the context of those embodiments, other embodiments may also exhibit such advantages, and not all embodiments need necessarily exhibit such advantages or other advantages disclosed herein to fall within the scope of the present technology.

Throughout this disclosure, the singular terms "a," "an," and "the" include plural referents unless the context clearly indicates otherwise. Similarly, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Additionally, the terms "comprising" and the like may be used herein to mean including at least the recited feature(s) such that any greater number of the same feature(s) and/or one or more additional types of features are not precluded. Directional terms, such as "upper," "lower," "front," "back," "vertical," and "horizontal," may be used herein to express and clarify the relationship between various elements. It should be understood that such terms do not denote absolute orientation. Reference herein to "one embodiment," "an embodiment," or similar formulations means that a particular feature, structure, operation, or characteristic described in connection with the embodiment can be included in at least one embodiment of the present technology. Thus, the appearances of such phrases or formulations herein are not necessarily all referring to the same embodiment. Furthermore, various particular features, structures, operations, or characteristics may be combined in any suitable manner in one or more embodiments of the present technology.

We claim:

1. An earpiece configured to be mounted to a user's ear, the earpiece comprising:

a housing including a peripheral side wall portion extending around the periphery of the housing and including a first peripheral side wall and a second peripheral side wall separated from the first peripheral side wall by a corner, wherein the peripheral side wall portion has— an outer surface, an elongate groove having a rim at the outer surface and extending from the first peripheral side wall, over the corner, and to the second peripheral side wall, and a filler within the groove;

a speaker within the housing; and an antenna including a radiating element within the groove, wherein the filler is between the radiating element and the outer surface.

2. The earpiece of claim 1 wherein:

the filler is transparent; and the peripheral side wall portion includes an opaque portion extending around the rim.

3. The earpiece of claim 2 wherein the opaque portion is made at least primarily of cellulose acetate.

4. The earpiece of claim 3 wherein the filler is made at least primarily of epoxy.

5. The earpiece of claim 1 wherein the antenna is an inverted-F antenna.

6. The earpiece of claim 5 wherein:

the peripheral side wall portion includes an opening extending from the groove to an interior of the housing; and the antenna includes a feeding pin extending through the opening.

7. The earpiece of claim 6 wherein:

the opening is a first opening;

the peripheral side wall portion includes a second opening extending from the groove to the interior of the housing; and the antenna includes a shorting pin extending through the second opening.

8. The earpiece of claim 7, wherein the radiating element extends around the corner and along the first peripheral side wall and the first opening and second opening extend from the portion of the groove extending along the second peripheral side wall.

9. A method for making an earpiece configured to be mounted to a user's ear, the method comprising:

forming a peripheral side wall portion extending around a periphery of a housing of the earpiece, the peripheral side wall portion including a first peripheral side wall and a second peripheral side wall separated from the first peripheral side wall by a corner;

forming an elongate groove in the peripheral side wall portion, the elongate groove extending from the first peripheral side wall, over the corner, and to the second peripheral side wall;

positioning a radiating element of an antenna of the earpiece within the groove;

disposing a filler material within the groove such that the filler material at least partially covers the radiating element;

increasing a hardness of the filler material; and abrading an outer surface of the wall at the filler material after increasing the hardness of the filler material.

10. The method of claim 9, further comprising positioning a speaker within the housing.

11. The method of claim 9 wherein forming the peripheral side wall portion includes forming the wall from cellulose acetate.

12. The method of claim 11 wherein disposing the filler material includes disposing epoxy resin.

13. The method of claim 9 wherein:

the peripheral side wall portion includes an opening extending from the groove to an interior of the housing; and the method further comprises extending a feeding pin of the antenna from the groove to the interior of the housing via the opening.

14. The method of claim 13 wherein:

the opening is a first opening;

the peripheral side wall portion includes a second opening extending from the groove to the interior of the housing; and the method further comprises extending a shorting pin of the antenna from the groove to the interior of the housing via the second opening.

* * * * *